US007575839B2

(12) United States Patent
Nakayama et al.

(10) Patent No.: US 7,575,839 B2
(45) Date of Patent: Aug. 18, 2009

(54) MAGNETIC TONER FOR TWO-COMPONENT DEVELOPER AND IMAGE FORMING METHOD USING THE DEVELOPER

(75) Inventors: Yukinori Nakayama, Tsu (JP); Kousuke Satou, Mie (JP); Kouzou Teramoto, Higashi-Osaka (JP); Hiroshi Mizuhata, Wakayama (JP)

(73) Assignee: Kyocera Mita Corporation, Osaka (JP)

( * ) Notice: Subject to any disclaimer, the term of this patent is extended or adjusted under 35 U.S.C. 154(b) by 565 days.

(21) Appl. No.: 11/394,349

(22) Filed: Mar. 30, 2006

(65) Prior Publication Data

US 2006/0222983 A1 Oct. 5, 2006

(30) Foreign Application Priority Data

Mar. 31, 2005 (JP) ..... 2005-102403

(51) Int. Cl.
*G03G 9/00* (2006.01)

(52) U.S. Cl. ..... 430/106.1; 430/110.4; 430/122.5; 430/122.51

(58) Field of Classification Search ..... 430/106.1, 430/110.4, 122.5, 122.51
See application file for complete search history.

(56) References Cited

U.S. PATENT DOCUMENTS 7,410,740 B2 * 8/2008 Nakayama et al. ..... 430/108.1

FOREIGN PATENT DOCUMENTS

| | | | |
|---|---|---|---|
| JP | 56-106249 | A | 8/1981 |
| JP | 59-162563 | A | 9/1984 |
| JP | 9-59024 | A | 3/1997 |
| JP | 11-153882 | A | 6/1999 |
| JP | 2000-162817 | A | 6/2000 |
| JP | 2000-242029 | A | 9/2000 |

* cited by examiner

*Primary Examiner*—Mark A Chapman

(57) ABSTRACT

The object is to provide a magnetic toner with which toner scattering, toner spent to carrier, development of scratch streaks by the magnetic brush on the photoreceptor drum can be prevented for a prolonged period and a good image characteristic (in image density and background fogging) can be maintained for a prolonged period, and an image forming method using the magnetic toner. A two-component developer comprising carriers and toner which contains magnetic particle at least in a binder resin thereof, the magnetic particle being of basically polyhedral shaped shape, vertexes and edges of said polyhedral shape being curved surfaces, said shape having peripheral parts taken as straight lines in a projected image thereof, saturation magnetization of said toner in a magnetic field of 79.6 kA/m being 4.0 to 15.0 $Am^2/kg$, is prepared, and the toner retaining members (carriers) bearing at least said magnetic toner to which electric charge is injected are allowed to face a latent image retaining member and an electrostatic latent image on said latent image retaining member is developed with said magnetic toner.

6 Claims, 4 Drawing Sheets

MAGNETIC TONER FOR TWO-COMPONENT DEVELOPER AND IMAGE FORMING METHOD USING THE DEVELOPER

BACKGROUND OF THE INVENTION

1. Field of the Invention

The present invention relates to magnetic toner for two-component developer consisting of magnetic toner containing magnetic particle in a binder resin and toner carrier, and image forming method of visualizing a latent image on a latent image retaining member using the two-component developer 2. Description of the Related Art In an image forming apparatus such as a laser printer utilizing electrophotographic method, electrostatic copy-machine, plain paper facsimile, and complex machine, first the surface of a latent image retaining member is charged evenly by charging means, then an electrostatic image is formed thereon through exposing by exposing means such as a semiconductor laser and light emitting diode, and then the electrostatic image is visualized as a toner image through developing or inverse-developing by developing means. Then the toner image is transferred directly onto the surface of a recording medium such as a sheet paper, or transferred onto the surface of an intermediate transfer member and then onto the surface of a recording medium such as a sheet paper. The transferred image is then fused in place by fusing means to end the image forming method.

Method of developing electrostatic images into toner images can be broadly classified into two categories, i.e. a dry-type and wet-type, of which the dry-type developing method is in widespread use in these days. The dry-type developing method can be assorted into two kinds by the kind of toner used, developing methods using magnetic toner which is composed of binder resin and toner to which magnetic particle is added internally or externally (single-component magnetic developing, two-component magnetic developing, etc.) and developing methods using toner without addition of magnetic particle (single-component nonmagnetic developing, two-component nonmagnetic developing, etc.).

In two-component developing methods, fine shapes of toner are retained on the surface of the carrier particle of iron or ferrite particle that is relatively large compared to the toner particle, by electrostatic force generated by the friction of the toner shape and carrier shape when they are mixed and stirred. When the mixture is transferred toward a photoreceptor in the form of a magnetic brush and comes adjacent to the electrostatic latent image, the attraction exerting to the toner particles to pull them toward the electrostatic latent image due to the electric field effected by the latent image surmounts the bonding force between the toner and carrier, and the toner adheres on the surface of the electrostatic latent image, thus the electrostatic latent image is visualized.

Although mainly nonmagnetic toner not containing magnetic power is used in a two-component developing method, to use magnetic toner for two-component developer has long been known. For example, in patent literature 1 (JP56-106249 A (1981)) and patent literature 2 (JP 59-162563 A (1983)) is recited to use toner containing magnetic particle. By allowing the toner for a two-component developer to contain magnetic particle, problems are often experienced in two-component developing that scattering or dusting of toner, i.e. flying of toner in all directions, or peeling or falling off of toner from the magnetic roll can be prevented and background fogging can be suppressed. Further, overcharging due to repetition of mixing and stirring of toner and carrier can be prevented by the leak of charge through the magnetic particle.

On the other hand, in recent years there is a demand for high speed, small size, and long lasting image forming apparatuses.

For a high speed apparatuses for mainly business use, it is demanded to quicken the initial rise of charge amount of toner and to retain the charge amount stable compared to conventional apparatuses in order to prevent decrease in resolution and degradation in image quality accompanying increased printing speed.

For a middle speed apparatuses intended for use in small offices and in homes, quick initial increase of charge of magnetic toner is necessary in order to shorten warm-up time after turning on power as far as possible, for turning-on and cutting-off of power are repeated frequently.

Further improvement in resolution, image quality, durability of magnetic toner, and stability under various environments are continuously demanded for image forming apparatuses irrespective of image forming speed depending on use.

Therefore, it is required for magnetic toner that charge amount increase quickly, proper charge amount is resulted always and maintained for a prolonged time without inducing insufficient charge amount and overcharging of toner under high temperature and high humidity environment under which electric charging of toner is difficult and under low temperature and low humidity environment under which toner tends to be electric charged excessively, and as a result a good image characteristic (high density of images without background fogging and good image quality) can be maintained stably for a prolonged time period under various temperature and humidity environments.

Scattering or dusting of toner, toner spent phenomenon in which the toner component adheres precipitates like a film on the surface of the carrier, and developing of scratched streaks on the photoreceptor drum by the magnetic brush, which have been problems when using a two-component developer, tend to occur more easily as printing speed and machine life are increased, so it is also required to evade these problems. However, these demands are becoming difficult to be sufficed enough in the current trend of increased printing speed and smaller size of image forming apparatuses.

Among the problems, development of scratched streaks on the photoreceptor drum which is a latent image retaining member by the magnetic brush is caused by the long time contact of the magnetic brush with the photoconductive surface of the photoreceptor. In a two-component developing method, a magnetic brush composed of two-component developer is formed on the magnetic roll on the part facing the photoreceptor, and image developing is carried out by bringing the magnetic brush into contact with the photoreceptor drum, so the photoreceptor drum is contacted with the magnetic brush for more and more prolonged time period as machine life is extended, and as a result the development of scratched streaks occurs. Heretofore, it has been tried to select carrier to cope with this problem.

However, in the case magnetic particle is contained in a two-component developer, there is possibility of developing the streaks by the magnetic brush by the influence of the magnetic particle.

The spent is a phenomenon that the toner component adheres on the surface of the carrier, and primary function of the carrier is lost when the surface of the carrier is covered with the toner component. Therefore, this is thought as deterioration of the carrier. When the spent phenomenon occurs, decrease in image density occurs and when things come to the worst the developer itself must be replaced by a new one. This spent has been a problem accompanying increased machine life, and possibility of its occurrence is increased in the situation that low temperature fusing of toner has prevailed in recent years. Further, when magnetic toner is used, there exists magnetic constraining force in addition to electrostatic force existing between the toner and carrier, so possibility of occurrence of the scratched streaks increases.

At present time, as a magnetic particle contained in toner, is generally used a particle of spherical shape (see FIG. 1(*a*)), or polyhedral shape such as hexahedral shape such as cube having six square faces or cuboid having six rectangular faces (see FIG. 1(*b*)) or octahedral shape having eight triangular faces (see FIG. 1(*c*)). However, in the case of a magnetic toner containing magnetic particle of polyhedral shape, electric charge tends to be discharged from pointed vertexes and sharp edges of the magnetic particle exposed on the surface of the toner, i.e. the binder resin, and leak of electric charge tends to occur more than necessary. Further, as a magnetic particle of polyhedral shape is low in fluidity and as a result dispersibility in binder resin deteriorates, so it is difficult to allow the magnetic particle to disperse evenly in binder resin. Therefore, variations tend to occur in the dispersion of magnetic particle particles in each of toner particles and easiness to be electric charged and charge amount of each of toner particles tend to scatter.

Accordingly, there is a problem that, with magnetic toner containing magnetic particle of polyhedral shape, quick rise of electric charge amount is difficult, and in addition charge amount itself is small, as a result scattering or dusting of toner and peeling or falling off of toner from the magnetic roll tend to occur, thereby inducing occurrence of flaws in images such as background fogging. Further, as easiness to be charged and charge amount vary depending on the temperature and humidity when the image is formed, there is a problem that the tendency of incurring flaws in the image under an environment of high temperature and high humidity, under which electric charging is difficult, becomes stronger.

Further, when magnetic toner containing magnetic particle of polyhedral shape is used, there is a problem that the pointed vertexes and sharp edges of the magnetic particle exposed on the toner cause magnetic brush streaking which does not occur easily in the case of toner not containing magnetic particle. But, on the other hand, there is an advantage that the pointed vertexes and sharp edges of the magnetic particle have an effect to prevent effectively the occurrence of spent phenomenon of toner to carriers due to their grinding effect.

On the other hand, in the case of magnetic toner containing magnetic particle of spherical shape which has no pointed vertex and sharp edge, the surface of the photoreceptor is hardly scratched by the magnetic particle exposed on the surface of the toner in the magnetic brush formed of the developer. This magnetic particle of spherical shape is better in fluidity, good in dispersibility in the binder resin compared to that containing magnetic particle of polyhedral shape, and can be easily dispersed evenly in the binder resin, so occurrence of variations in dispersion of magnetic particle particles in each of the toner particles is prevented, and occurrence of uneven distribution of magnetic particle in each magnetic toner particle is prevented and thereby easiness to be charged and charge amount of each of toner particles become uniform.

However, as the magnetic toner containing magnetic particle of spherical shape has no pointed vertex and sharp edge, occurrence of spent phenomenon can not be prevented and further release of charge from the magnetic particle exposed on the surface of the toner is hard to be expected, and there is a tendency of overcharging of toner. Therefore, when mixing and stirring of toner and carriers is repeated, toner tends to be excessively charged, that is, overcharge of toner tends to occur. Once the overcharge occurs, image flaws such as decrease in image density tend to occur.

Magnetic particle of various shapes has been investigated in order to take advantage of magnetic particle of spherical shape and of polyhedral shape. For example, magnetic particle of hexahedral or octahedral shape with its vertexes and edges being chamfered to form faces smaller than the faces of the hexahedron or octahedron is disclosed in JP11-153882 A (1999), JP2000-162817 A, and JP2000-242029 A (patent literature 3, 4, and 5 respectively). However, there still exist sharp edge lines formed by the faces of the polyhedron and the chamfered faces, and electric charge tends to be released form these edge lines. Therefore, there is still a possibility that image flaws such as decrease in image density and occurrence of background fogging due to charge leak from the magnetic particle, and when used as two-component developer, the surface of the photoreceptor is scratched by the magnetic brush.

In JP3584954 B (patent literature 6, JP9-59024 A (1997)) is disclosed a magnetic particle of cubic shape with each edge thereof is rounded to form a curved surface. However, in this magnetic particle, vertexes are also rounded together with the edges and there remain no sharp vertexes and edges, so release of electric charge tends to be difficult like spherical shape, and there is a possibility that the magnetic toner is overcharged and image flaws such as decrease in image density occurs particularly under low temperature and low humidity environment. Furthermore, when used as a two-component developer, occurrence of spent phenomenon can not be prevented enough due to the shape of the magnetic particle which is a curved surface on the whole.

In aforementioned patent literatures 1 and 2, suppression of scattering or dusting of toner and occurrence of background fogging is cited as advantage of two-component magnetic toner, however, behavior when forming a large number of images is not recited let alone the influence of the magnetic particle shape, and there is a possibility that stable charge amount can no be secured after forming a large number of images and streaks by the magnetic brush and spent phenomenon occur.

Of recent years, advancement of copying machines and printers, which adopt electrography using two-component developer, in speeding up of printing, downsizing of machine, and increasing of durability and operating life of machine is remarkable, and high resolution, superior image quality, and increased durability are required as a matter of course. Therefore, in order to attain an image characteristic and durability in accordance with increased printing speed, toner of a stable charging characteristic and superior performance is absolutely necessary.

SUMMARY OF THE INVENTION

The present invention was made on light of the problems of the prior art, and the object of the invention is to provide a highly durable magnetic toner with which toner scattering, toner spent to carrier, development of scratch streaks by the magnetic brush on the photoreceptor drum can be prevented for a prolonged period, and a good image characteristic (in image density and background fogging) can be maintained for a prolonged period by maintaining a proper amount of electric charge of the toner, and an image forming method using the magnetic toner.

Investigation was done diligently to solve the problem mentioned above. Inventors of the present invention focused attention on magnetic particle added to toner for a two-component developer used for electrographic systems adopted two-component developer type developing, and has come to complete this invention. More specifically, the inventors explored to use a magnetic particle of basically convex octahedral surrounded with eight triangles and of which vertexes and edges are curved surfaces as a magnetic particle to be contained in the toner for a two-component developer (see FIG. 1D).

The magnetic particle is basically of octahedral shape with its vertexes and edges being curved surfaces as shown for example in FIG. 2 which is a projected figure of the magnetic particle photographed by a transmission electron microscope (TEM). The feature is that it has no pointed vertex and sharp edge from which electric charge discharges. Although the vertexes and edges are curved surfaces, it is not to say that the adjacent vertexes and adjacent edges are connecting to each other when the curvature radiuses of the curved surfaces are too large to be formed into a somewhat sphere-like with no parts taken as straight lines being remained on the periphery of the projected figure thereof, but parts taken as straight lines must be remained on the periphery of the projected figure of the particle as can be seen in FIG. 2.

As the vertexes and edges of this magnetic particle are rounded to be curved surfaces and therefore the magnetic particle exposed on the toner has no pointed vertexes and sharp edges, it is thought that a magnetic brush of two-component developer containing this magnetic particle does not develop streaks on the photoreceptor drum, and as the magnetic particle has no pointed vertex and sharp edge, it is also thought that charge leak is difficult to occur when contained in the magnetic toner compared to the magnetic particle of polyhedral shape with its vertexes and edges being chamfered to be small flat surfaces as recited in patent literature 1-3.

Further, as the magnetic particle of polyhedral shape has vertexes and edges formed to be curved surface, it is excellent in fluidity and dispersibility in binder resin, and particularly easily dispersed evenly in the binder resin. Therefore, it is thought that occurrence of variation in dispersion of the magnetic particle in each binder resin can be prevented and easiness to be charged and the amount of electric charge of each toner particle can be made even.

Furthermore, the magnetic particle is of basically octahedral shape as shown in FIG. 1D and either of the intersection angle of adjacent faces straddling an vertex 1*b* or edge 1*a*, or either of the intersection angle of adjacent faces straddling a edge 1*a* is necessarily an acute angle smaller than 90°, and in the case of magnetic particle of cubic shape, either of the intersection angle of adjacent faces straddling an vertex or edge, or either of the intersection angle of adjacent faces straddling an vertex is necessarily 90°, so that the proper existence of vertexes where the faces or edges intersect and edges where the faces intersect effects to give grinding effect by the parts of the magnetic particle exposed on the surface of the toner particle, and the adhesion of toner to carrier, i.e. spent phenomenon can be effectively prevented. Further, as electric charge tends to concentrate to the vertexes where the faces or edges intersect and edges where the faces intersect, electric charge can be discharged therefrom in a proper proportion, and it is thought that overcharging of the magnetic toner when the magnetic particle is contained in the toner can be made difficult to occur.

Even when the toner particle shape is polyhedral, if the curvature radiuses of the vertexes 1*b* and edges 1*a* are too large, grinding effect of the parts of the toner not concealed in the toner can not be obtained, and occurrence of spent phenomenon can not be effectively prevented. Here, the inventors considered to define the limit of the curvature radius at the rounded vertex 1*b* and edge 1*a* as shown in FIG. 3 in the projected figure of the magnetic particle photographed for example by a transmission electron microscope.

As a result of investigation, the inventors came at the fact that, effect of preventing the spent phenomenon and overcharging of magnetic toner can not be obtained with a magnetic particle of which the magnetic particle has no straight line part on the periphery thereof in a projected figure and is somewhat like a sphere because of too large curvature radius of rounded vertexes 1*b* and edges 1*a* that continue to the adjacent faces intersecting at the vertexes 1*b* or edges 1*a*, as is the case with a spherical magnetic particle, on the contrary, in the case of a octahedral magnetic particle, the vertexes 1*b* and edges 1*a* being curved surfaces and having parts to be taken as straight lines on the periphery in the projected figure thereof, effect of preventing the occurrence of spent phenomenon can be obtained, because the curvature radiuses of the vertexes and edges are small compared to a spherical particle of similar size in spite of the existence the vertexes 1*b* and edges 1*a* are rounded to be curved surfaces; and that development of magnetic brush streaks on the photoreceptor drum can be prevented, electric charge can be discharged in a proper proportion from the vertexes 1*b* and edges 1*a* where electric charge tends to concentrate, and charge leak when the magnetic particle is contained in the toner can be made difficult to occur compared to the case a magnetic particle of which vertexes 1*b* and edges 1*a* are not rounded to be curved surfaces and yet overcharging of the magnetic toner can be prevented.

Further, magnetic characteristic of the toners containing these magnetic particles was investigated, and it was found that, when the saturation magnetization of the toner containing one of above mentioned magnetic particles is under 4.0 $Am^2/kg$ in a magnetic field of 79.6 kA/m (1 kQe), effect expected for two-component toner containing magnetic particle can not be obtained and occurrence of toner scattering can not be prevented.

When the saturation magnetization of the toner exceeds 15.0 $Am^2/kg$, there occurred a problem that magnetic constraining force becomes strong and scratch streaks are developed on the photoreceptor drum by the contact of the magnetic brush formed when the toner is used as a two-component developer with the photoreceptor drum at the developing region, and as the joining force to the carrier is strong, the spent phenomenon tends to occur.

The inventors investigated regarding the size of the magnetic particle and found that when the average size of the magnetic particle is smaller than 0.01 μm, there occurs a problem that the proportion of the magnetic particle exposed on the surface of the toner particle increases and electric charge is discharged from the exposed magnetic particle, resulting in insufficient electric charge thereof and decrease in image density, and on the other hand, when the average size exceeds 0.5 μm, the proportion of the magnetic particle exposed on the surface of the toner decreases and the amount of electric charge discharged from the magnetic particle decreases, resulting in overcharging of the magnetic toner, which induces decrease in image density particularly when image forming is repeated. Therefore, the average size of the magnetic particle is needed to be in a range of 0.01 to 0.50 μm.

Accordingly, the present invention proposes based on said finding a magnetic toner for a two-component developer comprising toner containing magnetic particle in a binder resin thereof and carriers, wherein the magnetic particle is of basically polyhedral shape, vertexes and edges of the polyhedral are curved surfaces, said particle has peripheral parts taken as straight lines in a projected image thereof, and saturation magnetization of said toner in a magnetic field of 79.6 kA/m is 4.0 to 15.0 $Am^2/kg$.

It is preferable that the polyhedron is a convex octahedron surrounded with eight triangles, and further that the average size of the magnetic particle is 0.01 to 0.50 μm. This average size is an average value of Martins's diameter (diameter corresponding to a circle) of 300 magnetic particle measured in a fourfold enlarged photograph (10 thousand magnification) which was taken by a transmission electron microscope.

By the way, well known dye stuffs, pigments, charge control agents, plasticizers, and external additives can be used. They are not particularly restricted, and also carriers for composing a two-component developer are not particularly restricted. The average size to the magnetic particle is preferable to be 0.05 to 0.35 μm inside of the range defined above considering proportion to other agents. It is preferable to use as the magnetic particle which consists of magnetite (triiron tetraoxide) containing 0.1 to 10% atom of Fe of at least one element selected from Mn, Zn, Ni, Cu, Al, Ti, and Si. Further, the proportion of the magnetic particle in the toner particle is preferable to be 2.0 to 20% wt on the same reason.

The magnetic toner of the invention can be obtained also by, when containing magnetic particle for example, mixing enough with binder resin, magnetic material, wax, charge control agent, and other additives in a mixer such as a Henschel mixer or ball mixer, then fusing and kneading using a hot kneader such as a heating roll, kneader, extruder to allow component agents to be dispersed or dissolved in resins fused into each other, cooling to solidify, then crushing and classifying, and further adding desired external additives and mixing enough in a mixer such as a Henschel mixer.

As thus composed magnetic particle of the invention is uniform in particle size distribution and excellent in dispersibility into the binder resin, it is possible to stabilize the electrostatic property thereof. Further, when ferrite carriers are used, even if the average size of the toner is smaller than 10 μm, charge uniformity is furthered and aggregation of the toner is alleviated, resulting in increase image density and improved developing property such as anti-fogging property.

Particularly, these improvements are prominent when the weight average particle size of 8.0 μm is used and extremely fine images can be obtained. The weight average particle size is preferable to be 3.0 μm or larger to obtain images fine enough. As the size reduction proceeds, liberation of the magnetic material tends to occur. By forming the volume average particle size of 0.05 to 10.0 μm using 0.1 to 10 parts by weight of magnetic particle of number average size of 0.05 to 0.35 μm for 100 parts by weight of binder resin, a toner of excellent adhesive property can be obtained and liberation of magnetic material and smearing of sleeve can be suppressed.

The image forming method using aforementioned two-component developer is a one wherein a two-component developer comprising carriers and toner which contains magnetic particle at least in a binder resin thereof, the magnetic particle being of basically polyhedral shape, vertexes and edges of said polyhedral being curved surfaces, said particle having peripheral parts taken as straight lines in a projected image thereof, saturation magnetization of said toner in a magnetic field of 79.6 kA/m being 4.0 to 15.0 $Am^2/kg$, is used, and the toner bearing members (carriers) bearing at least said magnetic toner to which electric charge is injected are allowed to face a latent image retaining member and an electrostatic latent image on said latent image retaining member is developed with said magnetic toner.

The invention can be applied not only to the image forming method in which the toner is electric charged by the friction with the carriers on the developer retaining member (development roll) and the development is carried out while forming a magnetic brush on the developing region of the roller facing the photoreceptor, but also to an image forming apparatus having a hybrid type development apparatus, in which are provided a magnetic roll for transferring the two-component developer on which the developer consisting of carriers and toner is electric charged and transferred by transfer bias in the form of a magnetic brush and a development roll on which a thin layer of only toner is formed, and development bias is applied to the proximate portion (development portion) of the development roll and latent image retaining member to develop the latent image on the latent image retaining member.

The image forming method is a one wherein said two-component developer comprising said carriers and said magnetic toner is allowed to form a chain of particles of the developer extending from said toner retaining member (hereafter referred to as a magnetic brush) toward the developing region of said latent image retaining member facing said toner retaining member by utilizing a magnetic field, whereby said latent image on said latent image retaining member is visualized as a toner image by allowing said magnetic brush to contact with the surface of said latent image retaining member, and wherein said magnetic toner contains magnetic particle at least in said binder resin, said magnetic particle has an average size of 0.01 to 0.50 μm and basically polyhedron shape, further vertexes and edges of the polyhedron are rounded to be curved surfaces, and said particle has peripheral parts taken as straight lines in a projected image thereof.

According to the invention, by using magnetic particle contained in the toner for two-component developer which is of basically octahedral shape and having its vertexes and edges formed into curved surfaces, toner can be obtained which has a charging characteristic of quick increasing in charge amount and at the same time of a tendency not to be overcharged. As a result, magnetic toner for two-component developer can be obtained with which toner scattering, toner spent to carrier, development of magnetic brush streaks which has been peculiar problems for two-component developers can be prevented and a good image characteristic (in image density and background fogging) can be maintained for an extended period. Therefore, magnetic toner for two-component developers of long durability while allowing to maintain the good image characteristic and an image forming method using the developer can be provided.

BRIEF DESCRIPTION OF THE DRAWINGS

FIG. 1A shows a spherical shape, FIG. 1B shows a hexahedral shape, FIG. 1C shows an octahedral shape, and FIG. 1D shows a rounded octahedral shape.

FIG. 3C is a plan view, FIG. 3A is a front view of a triangle part depicted with chain lines in FIG. 3C, and FIG. 3B is a side view viewed from the direction of a edge line depicted with a chain line in FIG. 3C.

DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 4:
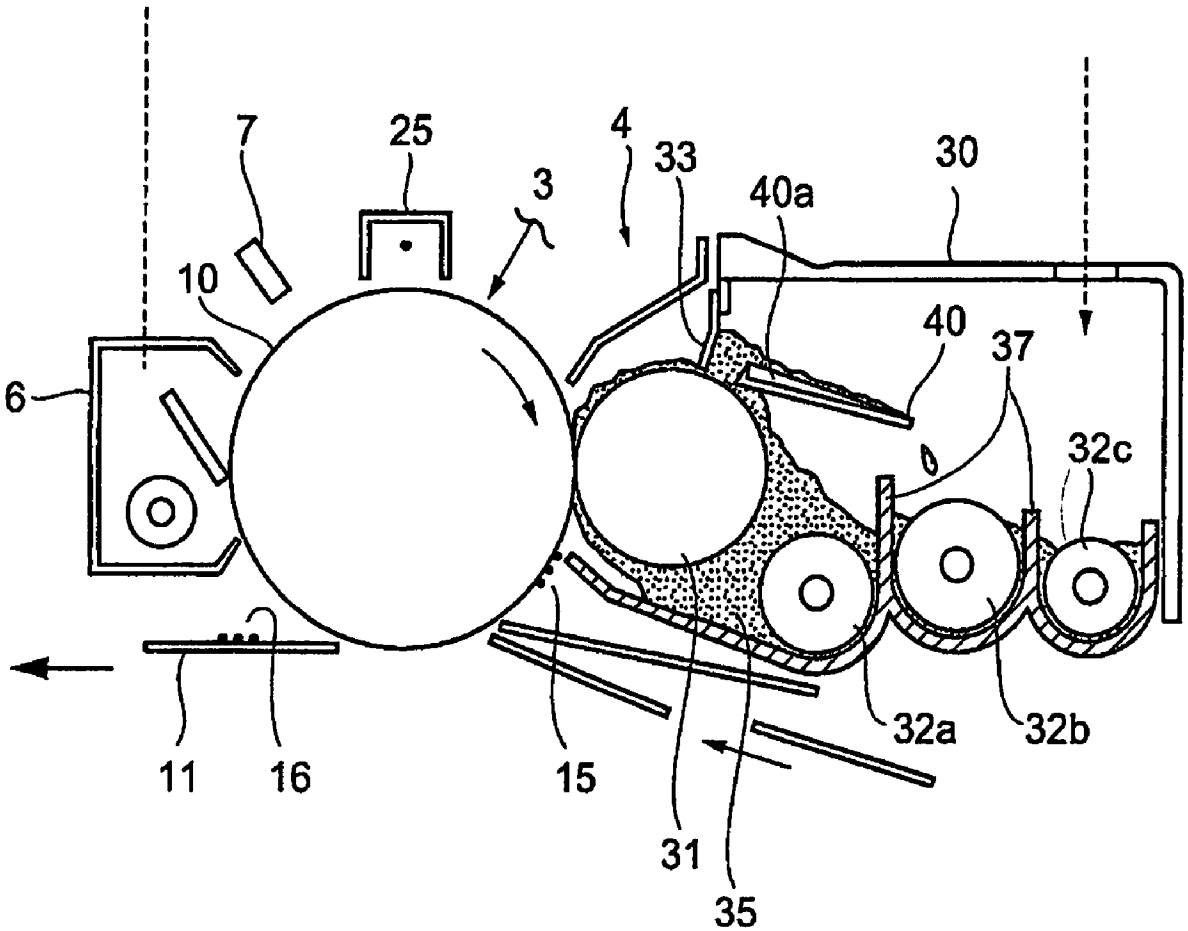
FIG. 4 is a schematic representation of the image forming apparatus employing the magnetic brush-type development apparatus according to the present invention.

FIG. 4 is a schematic representation of the image forming apparatus employing the magnetic brush-type development apparatus according to the present invention.

In the drawing, an electric charging device 25, an exposure device 3, a magnetic brush-type development apparatus 4, a transferring device not shown, a cleaning device 6, and a charge removing device 7 are located around a photoreceptor drum 10 along the rotation direction indicated with an arrow. A medium 11 to which to transfer images such as a sheet paper or OHP film is allowed to pass between the photoreceptor drum 10 and the transferring device not shown. A fusing device not shown is provided on a discharge pathway of the transferring device not shown.

As the photoreceptor drum 10 is used an inorganic photoreceptor drum composed of an electrically conductive roller made of aluminum, etc. with a photosensitive layer of selenium or amorphous silicon being formed on the surface thereof or organic photoreceptor drum with an organic photosensitive layer of binder resin with an electric charge generating agent or electric charge transfer agent being dispersed therein. As the electric charging device 25 are used a roller-type contact-charging device or corona charging device. The surface (photosensitive layer) of the photoreceptor drum is electrically charged uniformly by the charging device 25 to the determined polarity in accordance with the kind of the photosensitive layer. The electrostatic potential on the surface of the photoreceptor drum is usually 200-1000 V (absolute value). Then, dot ray such as laser beam corresponding to an original image is irradiated onto the surface of the photoreceptor drum in response to the reflected light from the original image or electric signal from a computer, etc. Electrostatic potential at the irradiated part is optical-attenuated thereby forming an electrostatic latent image.

The electrostatic latent image is developed by means of a magnetic brush formed on the magnetic brush-type development apparatus 4 to form a toner image 15 on the surface of the photoreceptor drum 10. As a developer 35 is used two-component developer consisting of magnetic carriers and magnetic toner.

The toner triboelectric charged to the determined polarity is transferred by the development apparatus in a form of magnetic brush to the photoreceptor drum thereby to develop the electrostatic latent image formed on the surface of the photoreceptor drum, thus the toner image 15 is formed on the surface of the photoreceptor drum.

The toner image 15 is transferred to the medium 11 to which images to be transferred by the transferring device not shown and transferred toner image 16 is formed on the medium 11. The medium 11 is transferred to the fusing device not shown and the transferred toner image 16 is fixated on the surface of the medium 11 by heat and pressure. After the toner image 15 is transferred onto the medium 11 as a transferred toner image, the toner remaining on the surface of the photoreceptor 10 is scraped off by a cleaning blade, etc. of the cleaning device 6 to be recovered. The electric charge on the surface of the photoreceptor 10 is removed by the light irradiation from the charge removing device 7 to be prepared for next image formation.

The magnetic brush-type development apparatus 4 comprises a developer housing 30 in which a developer 35 is filled. In the developer housing 30 are located a developer transferring sleeve 31 (development sleeve) to face the photoreceptor drum 10 and agitation paddles 32*a*, 32*b*, and 32*c* arranged in juxtaposition.

A multi-polar magnet is fixed in the development sleeve 31 and the developer is transferred in the form of a magnetic brush as the sleeve rotates. Usually, the gap between the surface of the development sleeve 31 and that of the photoreceptor drum 10 is set to be about 0.3-1.0 mm. Of course, the development sleeve 31 may be composed such that the sleeve is fixed and the developer is transferred by the rotation of the magnet in the sleeve. A doctor blade 33 is located so as to limit the depth of developer remaining adherent to the sleeve 31 to a certain gap (usually 0.3-1.0 mm) as the developer adhering to the sleeve is transferred to the nip between the sleeve 31 and photoreceptor drum 10 by the rotation of the sleeve 31 or the magnet in the sleeve. Thus the developer is transferred to the nip in the form of a magnetic brush with its ear length adjusted to a constant length, and development of the electrostatic latent image is carried out by the magnetic brush. The agitation paddles 32*a*, 32*b*, and 32*c* stir to mix the toner 35, thereby the toner in the developer 35 is sufficiently triboelectrical-charged. Each of the paddles are arranged so that the toner is transferred toward the development sleeve 31, party walls 37 partitioning adjacent paddles. With this construction, the toner is triboelectrical-charged efficiently.

In this way, the developer 35 with toner trioboelectrial-charged to the determined polarity is transferred to the developing area by the development sleeve 31 in the from of a magnetic brush having a constant ear length adjusted by the doctor blade 33, and development of the electrostatic latent image is performed.

A rectifier plate 40 is provided near the doctor blade 33 in the upstream of the developer transfer and the excessive developer on the magnetic sleeve 31 is guided by the rectifier plate 40 to fall down onto the agitation paddle 32*b* to be again stirred and mixed to be supplied to the development sleeve 31.

As material of the development sleeve 31 may be used a variety of known material. It is preferable that a developer carrying roll made of stainless steel with the surface being abrasive-blasted is used as the development sleeve 31.

Figure 2:
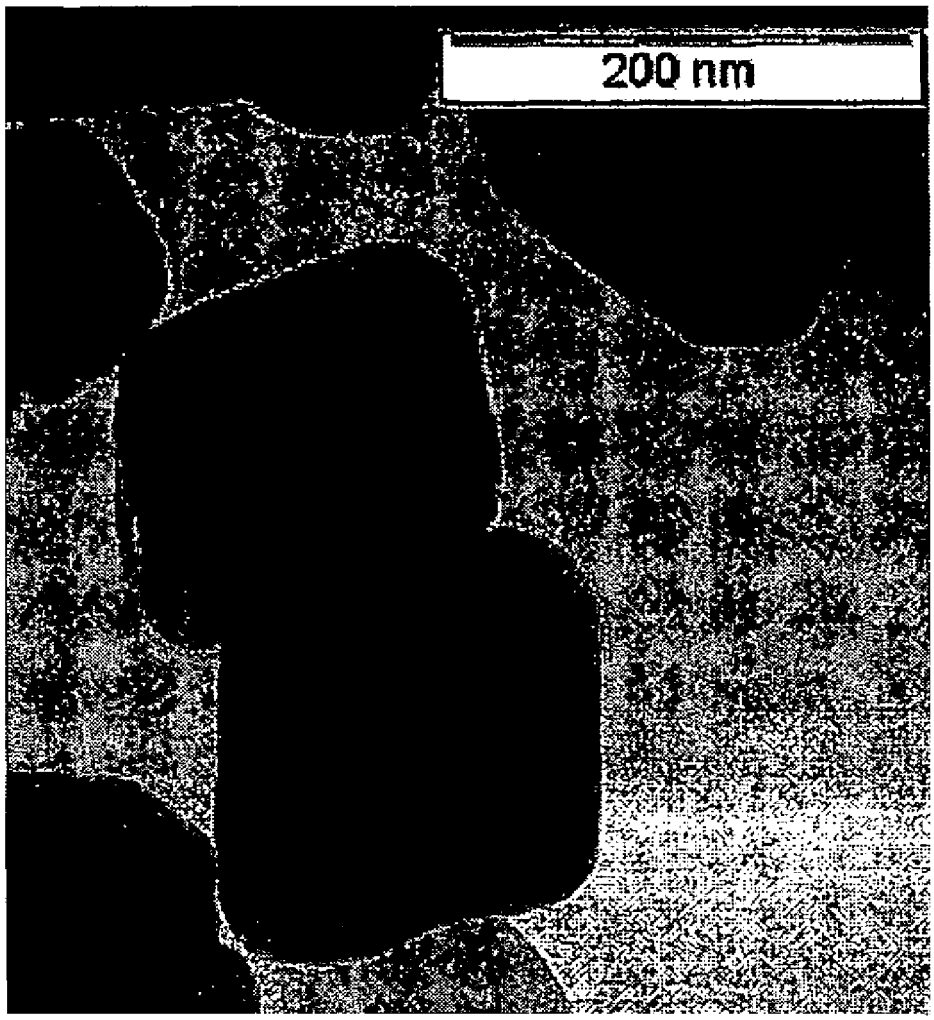
FIG. 2 is an electron micrograph showing an example of magnetic particle used in the magnetic toner of the present invention.
Figure 3A:
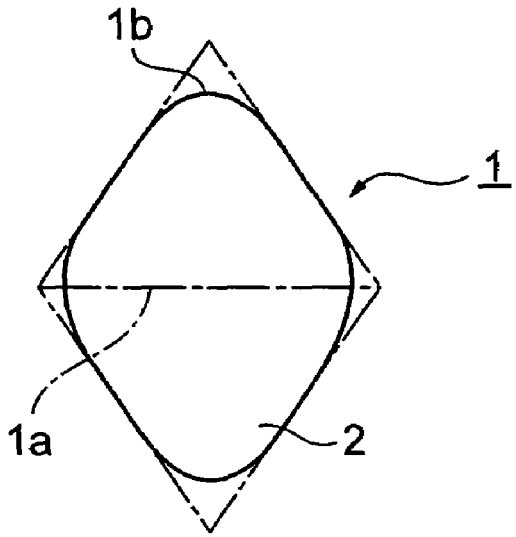
FIGS. 3A~C are a three-view drawing showing an example of magnetic particle used in the magnetic toner of the present invention.
Figure 3B:
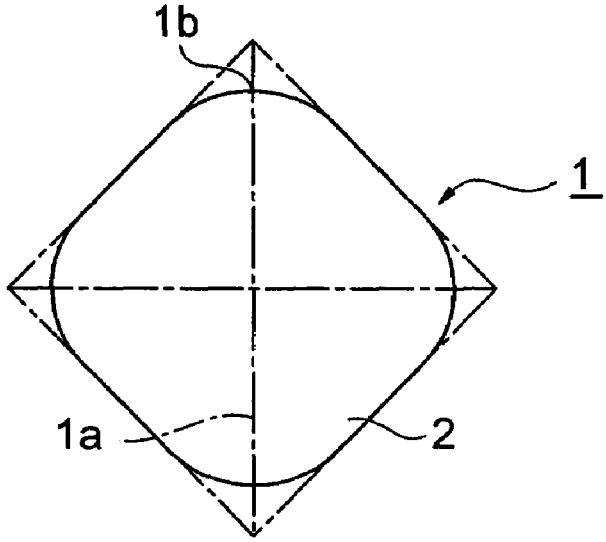
Figure 3C:
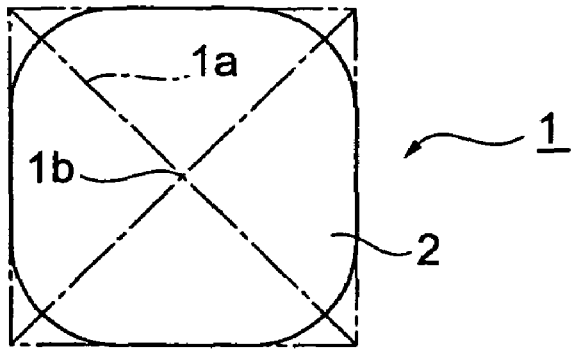

The toner of the present invention is magnetic toner with magnetic particle being admixed in binder resin. The magnetic toner contained in the toner of the invention is basically of a octahedron for example as shown in FIG. 3A~C with a chain line, a convex octahedron 2 surrounded with eight triangles, and each of the vertexes 1*b* and edges 1*a* of the octahedron 2 is rounded to be formed into a curved surface as shown with a solid line in the drawings. Further, said magnetic particle is featured as being $0.9 \leqq R1/R0 < 1$, where R1 is the actual peripheral length determined from the projected figure of the magnetic particle shown in FIG. 2 (the peripheral length corresponding to that shown with the solid line in FIG. 3B), and R0 is the peripheral length of the quadrangle circumscribing the projected figure (the peripheral length corresponding to that shown with the chain line in FIG. 3B, the quadrangle being an assumed periphery quadrangle when the vertexes 1*b* and edges 1*a* are not rounded).

The ratio R1/R0 is hereafter referred to as R value of magnetic particle.

When this R value of magnetic particle is less than 0.9, curvature of the vertexes 1*b* and edges 1*a* are too large, and there may be a case the electric charge can not be discharged in a moderate percentage particularly from the vertexes 1*b* where the edges 1*a* intersect with an acute angle or from the edges 1*b* where the surfaces intersect with an acute angle, thereby effect of preventing overcharging of toner is insufficient and degradation of image such as decrease in image concentration tend to occur.

When the value R of magnetic particle is 1, that is, when magnetic particle of which the vertexes 1*b* and edges 1*a* are not rounded (see FIG. 1C) is used, charge leak tends to occur from the pointed vertexes and sharp edges. Therefore, rapid increase of charge amount in the magnetic particle is difficult and the charge amount itself is reduced, as a result scattering of toner occurs. Furthermore, magnetic particle with pointed vertexes and sharp edges is low in fluidity, so dispersion in binder resin is not good. Therefore, there occur variations in easiness to be charged and the amount of charge.

In order to prevent overcharging of the magnetic particle while suppressing charge leak, R value of magnetic particle is preferable specifically to be in a range of 0.92-0.98, and more preferable to be in a range of 0.94-0.96.

In the invention, the ratio R1/R0 representing rounding degree of magnetic particle of basically octahedral shape with its vertexes 1*b* and edges 1*a* being rounded into curved surfaces was determined through following procedure. A projected figure of magnetic particle orienting as shown in FIG. 3*a* was selected from among projected figures of magnification of 200 thousand taken by a transmission electron microscope (JSM-800 made by Japan Electron Co. Ltd.), the selected figure was taken in a computer and binarized in black and white, then image analysis was carried out using an image analysis system (DA-6000 made by OJI Measuring Machine Co. Ltd.) to determine the peripheral length R1 and the peripheral length R0 which is determined by assuming a quadrangle circumscribing the projected figure, and the ration R1/R0 was calculated. Average value of calculated ratios R1/R0 was determined as R value of the magnetic particle.

The average size of the magnetic particle is needed to be 0.01-0.50 μm. When average size is less than 0.01 μm, percentage of magnetic particle exposed on the surface of the toner (binder resin) increases, discharge occurs from the exposed magnetic particle resulting in insufficient charging, and scattering of toner occurs. On the other hand, when average size exceeds 0.50 μm, percentage of magnetic particle exposed on the surface of the toner particle decreases, discharge form the exposed magnetic particle decreases resulting in overcharging. As a result, decrease in image density occurs after a large number of image forming.

Considering balancing of positive and negative effect, it is preferable that the average size of magnetic particle is specifically 0.05-0.35 μm, more preferably 0.15-0.30 μm. This average size can be obtained as an average value of Martins's diameter (diameter corresponding to a circle) of 300 magnetic particle in a fourfold enlarged photograph (10 thousand magnification) which was taken by a transmission electron microscope.

As magnetic particle can be cited ferromagnetic metal such as iron, nickel, alloy, their alloy, composition containing these elements, alloys not containing ferromagnetic elements but become ferromagnetic by proper heat treatment, or chromium dioxide, and among them magnetic particle composed of ferrite or magnetite is preferable. Specifically, considering to give good magnetic property to magnetic particle, it is preferable to use magnetic particle composed of magnetite containing 0.1-1.0 atom % of at least one element selected from Mn, Zn, Ni, Cu, Al, Ti, and Si.

Magnetic particle of cubic shape composed of said magnetite is disclosed in the cited patent literature 6. magnetic particle of octahedral shape with vertexes 1*b* and edges 1*a* being curved surfaces and which has linear parts taken as straight lines in its projected figure and of which average size is in the range defined above, can be produced through for example following procedure:

26.7 liter of aqueous solution of iron(II)sulfate salt containing 1.5 mol of $Fe^{2+}$ per 1 liter of water is added to 25.9 liter of aqueous solution of sodium hydroxide of 3.4N (which corresponds to 1.1 equivalence to $Fe^{2+}$) prepared in a vessel, and heated to 90° C. to produce a suspension of iron(II)salt containing iron(II)hydroxide colloid while maintaining pH to 10.5.

Then, 100 liter/minute air is blown into the suspension for 80 minutes while maintaining the temperature of the liquid at 90° C. to allow oxidative reaction continue until oxidization percentage of the iron(II) salt reaches 60%. Then, after adding aqueous solution of sulfuric acid to the suspension to reduce pH thereof to 6.5, 100 liter/minute air is blown into for 50 minutes while maintaining the temperature of the liquid at 90° C. to produce magnetite particles in the suspension.

After adding aqueous solution of sodium hydroxide to the suspension containing the magnetite particles so that pH of the suspension becomes 10.5, 100 liter/minute air is blown into for 20 minutes while maintaining the temperature of the liquid at 90° C. Then, the magnetite particles are water-washed and filtered by a usual method to obtain magnetite particles. The magnetite particles are dried and the agglomeration of magnetite particles is crushed. In this way, magnetic particle of which the shape is basically octahedral with vertexes 1*b* and edges 1*b* being curved surfaces is obtained.

In the method described above, by adding water-soluble metallic compound or compounds such as water-soluble silicate by an amount which constitutes 0.1-10 atom % of Fe and adjusting pH of the liquid 8.0-9.5 when oxygen-bearing gas blowing into the liquid is started in the first step of reaction, magnetic particle composed of magnetite containing 0.1-1.0 atom % of at least one element selected from Mn, Zn, Ni, Cu, Al, Ti, and Si is obtained.

R value of the magnetic particle can be adjusted in the range defined above by changing the reaction percentage of the oxidative reaction at the first step oxidization.

It is preferable that the proportion of magnetic particle is 1.0-35 parts by weight per 100 parts of resin by weight, more preferably 2.0-25 parts by weight.

When the proportion of magnetic particle is under this range, retentivity of toner by the magnetic force of the magnet located inside the developer retaining member decreases, thereby background fogging may occur in the image there and toner scattering can not be suppressed. When the proportion of magnetic particle is above this range, retentivity of toner by the magnetic force becomes too strong, and image concentration may decreases. Further, as the proportion of binder resin decreases, fixing ability of the toner to the surface of a recording medium such as a sheet paper may decreases resulting in decreased durability of the printed image.

Taking into consideration that magnetic particle is allowed to disperse evenly in the binder resin, the magnetic particle may be surface-treated with a surface treatment agent such as a coupling agent of titan group, coupling agent of silane group, coupling agent of aluminum group, and a variety of fatty acids. Among these, the coupling agent of silane group is preferable. There can be cited for example as a specific compound, hexamethyldi silazane, trimethylsilane, trimethylchlorsilane, trimethylethoxysilane, dimethylchlorsilane, aryldimethylchlorsilane, arylphenyldichlorsilane, benzyldimethylchlorsilane, bromomethyldimethylchlorsilane, α-chlorethyltrichlorsilane, β-chlorethyltrichlorsilane, chlormethyldimethylchlorsilane, triorganosilylmercaptan, trimethylsilylmercaptan, triorganosilylacrylete, vinyldimethylacetoxisilane, dimethyldiethoxysilane, dimethyldimethoxysilane, diphenylethoxysilane, hexamethyldisiloxane, 1,3-divinyltetramethyldisilxane, and 1,3-diphenylteramethyldisiloxane, etc.

Dimethylpolysiloxane, etc. having 2-12 siloxane units in one molecule and including a hydroxyl bonding to a silicon at each of siloxane units located at terminal positions of the molecule, can be used.

The toner is needed to contain a magnetic particle of which saturation magnetization in a measurement magnetic field of 79.6 kA/m is 4.0-15 $Am^2/kg$.

When the saturation magnetization is under this range, primary effect of the inclusion of magnetic particle in two-component developer can not be expected, and occurrence of toner scattering can not be prevented effectively. When the saturation magnetization is above this range, magnetic constraining force between the toner and carrier is too strong, and the magnetic brush consisting of the two-component developer causes streaks of scratch on the surface of the photoreceptor drum. Further, as bonding with the carrier is strong, spent phenomenon tends to occur. Considering both the advantageous effect and reverse effect, saturation magnetization of the magnetic particle is more preferably 4.5-14.0.

The toner of the invention is obtained by dispersing a variety of compounding ingredient such as a coloring agent into the binder resin. There is no restriction as to the kind of binder resin used in the toner of the invention, but it is preferable to use thermoplastic resin such as, for example, styrene type resin, acrylic type resin, styrene-acrylic copolymer, polyethylene type resin, polypropylene type resin, vinyl chloride type resin, polyester type resin, polyamide type resin, polyurethane type resin, polyvinylalcohol type resin, vinylether type resin, N-vinyl type resin, styrene-butadiene type resin, etc.

As polystyrene type resin can be cited binary or ternary or multiple copolymer of styrene monomer and others in addition to copolymer of styrene monomer.

Of these, single kind can be used, and also combination of a plurality of kinds can be coplymerized with styrene monomer.

As a monomer for coplymerization can be cited, ethylene unsaturated mono-olefin group such as p-chlorstyrene, vinyl naphthalene, ethylene, propylene, butylene, isobutylene, etc.; vinyl halide such as vinyl chloride, vinyl bromide, vinyl fluoride, etc.; vinylester group such as vinyl acetate, vinyl propionate, vinyl benzoylate, vinyl acetate, etc.; (meta)acrylic ester such as methyl acrylate, ethyl acrylate, n-butyl acrylate, 2-chlorethyl acrylate, phenyl acrylate, α-methyl chloracrylate, methyl methacrylate, ethyl methacrylate, butyl methacrylate, etc.; derivatives of other acrylic acid such as acrylonitryl, methacrylonitryl, acrylamide, etc.; vinylester group such as vinylmethylether, vinylisobutyleter, etc.; vinylketone group such as vinyl methylketon, vinyl ethylketon, methylisopropenylketon, etc.; and N-vinyl compounds such as N-vinylpyrrole, N-vinylcarbazole, N-vinylindole, N-vinylpyrrolidone, etc. Single kind among these monomers can be used, and also combination of a plurality of monomers of these monomer can be coplymerized with styrene monomer.

As polyester type resin can be cited a variety of polyester type resin obtained by condensation polymerization or condensation copolymerization of alcohol component and carboxylic acid component. As components used when synthesizing polyester type resin can be cited for example, first for alcohol component of oxidation number of 2 or 3 or over, diol group such as ethylene glycol, diethylene glycol, triethylene glycol, 1,2-propylene glycol, 1,3-propylene glycol, 1,4-butanediol, neopentyl glycol, 1,4-butenediol, 1,5-penthanediol, 1,6-hexanediol, 1,4-cyclohexanedimethanol, dipropylene glycole, polyethylene grycol, polypropylene glycole, polyteramethylene glycole, etc.; bisphenol group such as bisphenol A, hydrogenated bisphenol A, polyoxiethylenated bisphenol A, polyoxipropylenated bisphenol A, etc.; and alcohol group of oxidation number of 3 or over such as sorbitol, 1,2,3,6-hexanetetrol, 1,4-sorbitan, pentaneerithritol, di pentaneerithritol, tri pentaneerithritol, 1,2,4-butanetriol, 1,2,5-pentanetriol, glycerol, doglycerol, 2-methylpropanetriol, 2-methyl-1,2,4-butanetriol, trimethylolethane, trimethylolpropane, 1,3,5-hydroximethylbenzen, etc.

As carboxylic acid component of oxidation number of 2 or 3 or over can be cited for example, carboxylic acids of oxidation number 2 such as alkyl- or alkenylsuccinic acid, supecifically such as maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccunic acid, iso dodecenylsuccinic acid, etc.; and carboxylic acid of oxidation number 3 or over such as such as 1,2,4-benzentricarboxylic acid (trimellitic acid), 1,2,5-benzentricarboxylic acid, 2,5,7-naphtalenetricarboxylic acid, 1,2,4-naphtalenetricarboxylic acid, 1,2,4-buthanetricarboxylic acid, 1,2,5-hexanetricarboxylic acid, 1,3-dicarboxyl-2-methyl-methylenecarboxipropane, 1,2,4-cyclohexanetricarboxylic acid, teta(methylenecarboxyl) methane, 1,2,7,8-octanetetracaboxyl acid, pyromellitic acid, empole trimer acid etc.

Softening point of polyester group resin is preferable to be 110-150° C., more preferably 120-140° C.

Binder resin may be thermosetting resin. By inducing partly cross linkage like this in the carrier resin, durability of resin such as stability in storage and retention of the shape of the resin can be increased without decreasing fixative ability. Therefore, it is not necessary that all of 100 parts of resin by weight consist of thermoplastic resin, it is preferable that a cross-linking agent is added or thermosetting resin are used partly. Epoxy resin or cyanate resin etc. can be used as thermosetting resin. More specifically, one or combination of two or more of bisphenol A type epoxy resin, hydrogenated bisphenol A type epoxy resin, novolac epoxy resin polyalkyleneether epoxy resin, cyclic aliphatic epoxy resin, cyanate resin can be considered.

Glass transition temperature Tg of binder resin is preferable to be 50-65° C., more preferably 50-65° C. When the glass transition temperature is under this range, fusion of toner tends to occur and storage stability may decreases. Furthermore, as the strength of resin is low, it adheres to the surface of the latent image retaining member and does not clear away therefrom easily, resulting toner adhesion thereto. On the contrary, when the glass transition temperature is above this range, fixing ability of the toner to the surface of the recording medium such as a sheet paper may deteriorate.

Glass transition temperature of binder resin can be determined from an endothermic curve obtained for example by a differential scanning calorimeter (DSC) by finding the changing point of specific heat. Specifically, for example, it can be determined by measuring using a differential scanning calorimeter DSC-6200 (SEIKO Instruments Inc.) in such a way in that 10 mg of sample resin is received in an aluminum pan and an empty aluminum pan is prepared as a reference pan, and measurement is carried out under ordinary pressure and in a temperature range of 25 to 200° C. with warm-up rate of 10° C. per minute to obtain an endothermic curve of the sample resin. The temperature at the transition point on the endothermic curve is determined as the glass transition temperature the binder resin.

A charge control agent is a component blended for improving the charge level and rate of charge rise of toner to obtain developer of excellent durability and stability. A positive charging type charge control agent can be added in the case of development by positive charged toner, and a negative charging type charge control agent can be added in the case of development by negative charged toner.

As such a charge control agent of positive charging property can be cited for example, azine compound such as pyridazine, pyrimidiene, pyrazine, orthooxazine, metaoxazine, paraoxazine, orthothiazine, metathiazine, parathiazine, 1,2,3-triazine, 1,2,4-triazine, 1,3 5-triazine, 1,2,4-oxaziazine, 1,3,4-oxaziazine, 1,2,6-oxaziazine, 1,2,6-oxaziazine, 1,3,4-thiaziazine, 1,3,5-thiaziazine, 1,2,3,4-tetrazine, 1,2,4,5-tetrazine, 1,2,3,5-tetrazine, 1,2,4,6-oxatriazine, 1,3,4,5-oxatriazine, phtalazine, quinazoline, quinoxaline, etc.; direct dye consisting of azine compound such as azinefirast redFC, azinefirstred12BK, azinevioletBO, azinebrown3G, azinelightbrownGR, azinedarkgreenBH/C, azinedeepblackEW, azinedeepblack3RL, etc.; nigrosine compound such as nigrosine, nigrosine salt, nigrosine derivatives, etc.; acid dye consisting of nigrosine compound such as nigrosinBK, nigrosinNB, nigrosinZ, etc.; metal salt of naphtenic acid or higher fatty acid; amine alkoxylate; alkylamide; and quaternary ammonium salt such as bennzilmethylhexyldecylammonium, decyltrimethylammoniumchloride, etc. These can be used as a single agent or combined agent of two or more of these agents. Particularly, nigrosine compound is most suitable for use for positive charging toner from point of view of quick rise of charge amount.

Further, quaternary ammonium salt, carboxylate salt, or styrene-acrylic resin (stylene-acryl group copolymer) having a carboxyl group as a functional group, are suitable for charge control agent in that the charge amount of toner can be easily controlled in a desirable range by these agents. More specifically, there can be cited one or two kind or over of styrene resins having quaternary ammonium salt, acrylic resin having quaternary ammonium salt, styrene-acrylic resin having quaternary ammonium salt, polyester resin having quaternary ammonium salt, styrene resin having carboxylate salt, acrylic resin having carboxylate salt, styrene-acrylic resin having carboxylate salt, polyester resin having carboxylate salt, polystyrene resin having carboxyl group, acrylic resin having carboxyl group, styrene-acrylic resin having carboxyl group, and polyester resin having carboxyl group, etc.

Particularly, styrene-acryl group copolymer resin having quaternary ammonium salt as a functional group is most suitable from point of view of quick rise of charge amount. As preferable acrylic comonomers to be copolymerized with a styrene monomer can be cited arkylester (meth)acrylate such as methyl acrylate, ethyl acrylate, n-propyl acrylate, ISO-propyl acrylate, n-butyl acrylate, ISO-butyl acrylate, 2-ethylhexyl acrylate, methyl methacrylate, ethyl methacrylate, n-butyl methacrylate, ISO-butyl methacrylate. Fureter, a monomer derived from dialkylaminoalkyl(meth)acrylate through the method of changing to a quaternary compound is used as quaternary ammonium salt.

Dialkylaminoethyl(meth)acrylate, such as dimethylaminoethyl(meth)acrylate, diethylaminoethyl(meth)acrylate, dipropylaminoethyl(meth)acrylate, dibuthlaminoethyl (meth)acrylate, etc.; dimethylmethacrylamide; and dimethylaminopropylmethacrylamide etc., for example, are suitable for dialkylaminoalkyl(meth)acrylate from which said monomer is derived. Hydroxy group containing monomer such as hydroxiethyl(meth)acrylate, hydroxipropyl(meth)acrylate, 2-hydroxibutyl(meth)acrylate, N-methylol(meth)acrylate, etc. can be used together when polymerizing.

As a charge control agent of negative charging property, an organometalic complex and chylate compound, for example, are effective. As examples, there are aluminumacetylacetonat, iron(II)acetylacetonat, 3,5 di-tert-butylchromesahcylate, etc. and particularly acetylaceton metallic complex, salicylic acid group metallic complexes or salt are suitable, among them metallic complex salicylate or metallic salt salicylate is more suitable. The percentage of the charge control agent in the toner is preferable to be 0.5 to 15% by weight, 0.5 to 8.0% by weight is more preferable, and 0.5 to 7.0% by weight is particularly preferable. When the percentage of the charge control agent is under this range, it is difficult to give a stable charging characteristic to the magnetic toner, and there may occur decrease in image density and decrease in durability of the toner. Furthermore, there may occur background fogging because of easier occurrence of deteriorated dispersion into the binder resin, and aggregated charge control agent not dispersed into the binder resin may contaminate the photoreceptor drum. On the contrary, when the percentage exceeds the above defined range, durability of the magnetic toner in various environment decreases, and insufficient charging and degradation of image in particular under high temperature, high humidity tend to occur. Furthermore, there may occur background fogging because of easier occurrence of deteriorated dispersion into the binder resin, and aggregated charge control agent not dispersed into the binder resin may contaminate the photoreceptor drum.

As to wax used for improving fixing property and offset property, it is preferable to use, for example, polyethylene wax, polypropylene wax, Teflon group wax (Teflon is a registered trade name.), Fischer-Tropsch wax, paraffin wax, ester wax, montan wax, rice wax, etc. Two kind or over of these wax may be used. By adding the wax, offset property can be improved and smearing of image can be prevented more effectively.

Above mentioned wax is generally preferable to be contained 1 to 5 parts by weight per 100 parts of toner by weight. When the amount of the wax is less than 1 parts, offset and image smearing may not be prevented effectively, on the contrary, when the amount of wax exceeds 5 parts, toner fuses with each other and storage safety tends to decrease.

The toner of the invention can be obtained by mixing the binder resin recited above with various compounding agents such as a charge control agent, etc., fusing and kneading by the use of a kneader such as an extruder, then cooling, crushing, and classifying. Particle size of toner thus obtained is preferable to be 5.0 to 10.0 μm by volume average particle diameter. When the average size is under than this range, fluidity decreases and background fogging may occur. When the average size exceeds this range, image quality is degraded.

The toner thus produced may be surface treated as necessary with for example fine particles of colloidal silica, hydrophobic silica, alumina, titanium oxide, etc. (external additives with average size of 1.0 μm or smaller) in order to improve the cleaning feature which represents fluidity, storage stability, and easiness to be removed from the surface of the latent image retaining member. The surface treatment is preferably carried out by dry-blending of magnetic toner with an external additive, and preferably by using Henschel or Nauter mixer. The amount of the external additive is preferable to be 0.2 to 10.0% by weight of the toner particles. Further, the external additive may be surface treated as necessary with aminosilane, silicone oil, silane group coupling agents (hexamethyodisilazane, etc.), titan group coupling agents, etc.

In the embodiment, the carrier used to compose two-component developer is of 20 to 150 μm of weight average particle size, preferably of 20 to 100 μm. By this, the toner concentration of the toner layer in the developing region can be increased, so images with high image density can be obtained even under the condition of high speed printing in a high speed machine. As a core particle of the carrier composing the toner of the invention can be used well known material, for example, ferromagnetic metal such as iron, cobalt, nickel, etc.; alloy or compound such as magnetite, hematite, ferrite, etc.; and composite material of said ferromagnetic particles and resin, etc.

The carrier used in the invention is preferable to be coated with resin for improving durability. As resin to form coating layer can be cited for example, polyolefin group resin such as polyethylene, polypropylene, chlorinated polyethylene, chlorosulfonated polyethylene, etc.; polyvinyl and polyvinylidene group resin such as polystylene. Acryl(e.g. polymethylmethacrylate), polyacrylonitrile, polyvinylacetate, polyvinylalcohol, polyvinylbutyral, polyvinylchloride, polyvinylcarbazole, polyvinylether, polybiliketone, etc.; vinylchloride-vinylacetate copolymer; silicone resin composed by organosiloxane bonding or its metamorphosed one (metamorphosed by alkyd resin, polyester resin, epoxy resin, polyurethane, etc. for example); fluororesin such as polytetrafluoroethylene, polyfluorovinyl, polyfluorovinilidene, polychlorotrifluoroethylene, etc.; polyamide; polyester; polyurethane; polycarbonate; amino resin such as urea-formaldehyde, etc.; and epoxy reain, etc.

Electric conductivity imparting material may be dispersed in the coating layer of the carrier used in the invention in order to control its volume resistivity. As the electric conductivity imparting material may be used well known material, for example, metal such as iron, gold, cupper, etc.; iron oxide such as ferrite, magnetite; pigment such as carbon black, etc.

Particularly, by using a mixture of furnace black which is one of carbon black and acetylene black, it became possible to obtain a carrier capable of being effectively adjusted in electric conductivity by the addition of small amount of electric conductive fine particles and excellent in durability of the coating layer thereof. These electric conductive fine particles are preferable to be of about 0.01 to 10 μm, and the amount of addition to be 2 to 30 parts by weigh per 100 parts by weight of coating resin, more preferable to be 5 to 20 parts by weight.

Further, silane coupling agent, titan coupling agent, etc. may be added to the coating layer of the carrier in order to improve adhesiveness to the core particle of the carrier and to improve dispersibility of the electric conductivity imparting agent. The coating layer can be formed by spraying coating layer forming liquid onto the surface of the carrier particles or by dip coating as has been done conventionally. The thickness of the coating layer is preferable to be 0.1 to 20 μm, preferably 0.2 to 5.0 μm.

In the invention, as mix proportion of the toner and carrier when producing two-component developer, it is preferable that the amount of the toner is 2.0 to 20 parts by weight per 100 parts of the carrier, more preferably 3.0 to 15 parts by weight. When the amount of the toner is under this range, overcharging occurs and image density decreases. On the contrary, when the amount of the toner exceeds this range, background fogging and scattering of toner occurs.

PRACTICAL EXAMPLE

Hereunder, the present invention will be explained based on a practical example. Of course, it is to be clearly understood that the explanation below is made only by way of example and not as a limitation on the scope of invention.

To produce binder resin, 15 parts by weight of magnetic particle, 5 parts by weight of wax (Southal wax H1 of Southal Co. made) as a release agent, 5 parts by weight of quarternary ammonium salt (BontoronP-51 of Orient Chemistry Co. made) as positive charge controlling agent, and 5 parts by weight of carbon black as a coloring agent were added to 70 parts in weight of styrene-acryl copolymer of which peak molecular weight of low molecular weight is 8000, peak molecular weight high low molecular weight is 130,500, and glass transition temperature Tg is 55.0° C., the mixture was fused and kneaded in a two axle extruder, then cooled, and rough-crushed by a hammer mill.

Figure 1A:
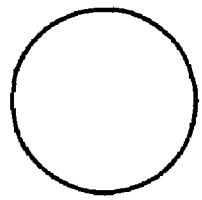
FIGS. 1A~D are a schematic drawing showing examples of the magnetic particle shape included in toner.
Figure 1B:
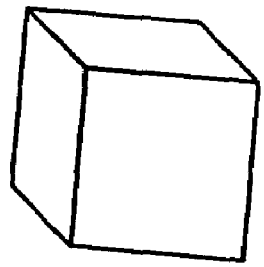

The rough-crushed material was then fine-crushed by a mechanical crusher, classified by an air-flow type classifier, and toner of volume average particle size of 7.0 μm was obtained. The magnetic particle was used of which the shape was of convex octahedron surrounded with eight triangles as shown in FIG. 1D, its vertexes 1*b* and edges 1*a* were curved surfaces, the ratio R1/R0, i.e. R value determined by the aforementioned method was 0.95, and average size was 0.20 μm.

Water solution of ferrous salt of 1 equivalent was reacted with water solution of alkali hydroxide of 0.08 to 0.99 equivalent to produce ferrous salt reacted water solution containing ferrous hydroxide colloid. Oxygen-bearing gas was blown into this water solution while heating the water solution to a temperature range of 70 to 100° C. to produce magnetite. Alkali hydroxide solution was added at the first step reaction of generating core crystal particles and at the time when the oxidative reaction rate exceeds 50% to raise pH to 10 or over. Then oxygen-bearing gas was blown into while heating the solution to a temperature range of 70 to 100° C. to allow the second step reaction. In this way, magnetic iron oxide particles composed of magnetite were obtained of which the shape was basically hexahedral and octahedral with each of their edges 1*a* being curved surfaces.

Titan oxide (EC-100 of Titan Industry CO. made) of 1.0 parts by weight and silica (RA-200H of Japan Aerosil Co. made) of 1.0 parts by weight were adhered to the surfaces of the toner particle (magnetic particle) particles of 100 parts by weight thus obtained by means of a Henschel mixer. This toner was used for the developer of embodiment example 1. Other toner particles were produced in the same manner as in embodiment example 1 with the exception of magnetic particle to obtain toner particles to use for developers of embodiment example 2 to 3 and comparative example 1 to 7. They are detailed in Table 1. Two-component developer was obtained by mixing 10 parts by weight of the magnetic toner thus obtained with 100 parts by weight of the magnetic carrier (50 μm, Particle Tech Co. made) by a Nauter mixer.

Amount of toner spent to carrier, magnetic brush streaks on the surface of the photoreceptor drum, toner scattering, the image characteristic, and the charging characteristic of developer were evaluated using the two-component developers in a modified KYOCERA-MITA made digital complex machine KM-1650 revamped beforehand to two-component developer type. Evaluation method of each characteristic is described hereunder, and the result of evaluation is given in Table 1. Particle shapes of the magnetic particles were as follows:

R.OCTAHEDRON; rounded octahedron, i.e. octahedron with vertexes and edges being curved surfaces.

Figure 1C:
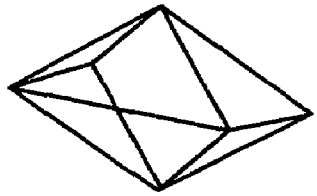
Figure 1D:
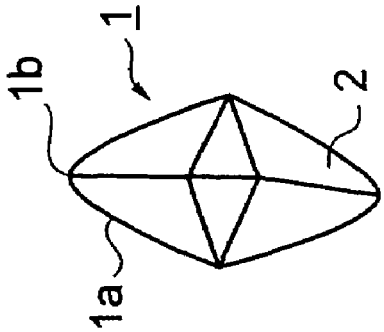

C.OCTAHEDRON; cornered octahedron, i.e. octahedron with vertexes and edges being not curved surfaces, i.e. usual octahedron (see FIG. 1C).

F.OCTAHEDRON; chamfered octahedron, i.e. octahedron with vertexes and edges being chamfered to be small flat faces (see FIG. 6 of patent literature 3)

C.CUBE; cornered cube, i.e. cube with vertexes and edges being not curved surfaces, usual cube (see FIG. 1B).

F.CUBE; chamfered cube, i.e. cube with vertexes and edges being chamfered to be small flat faces.

SPHERE; sphere (see FIG. 1A).

Image evaluation pattern was printed by said page printer at the early stage. This figure was named the initial image.

Then, 150 thousands sheets of manuscript of ISO 4% were continuously printed. After this, the evaluation pattern was again printed. This was named the image after endurance printing.

These solid images were measured by a Macbeth densitometer (RD914) and at the same time visual observation was made to evaluate the image characteristic. Image density of 1.30 or over was evaluated as good (OK). Evaluation of background fogging was done as follows:

○; no background fogging was observed,

Δ; some degree of background fogging was observed, and

X; severe background fogging was observed.

Toner scattering from the development apparatus was visually observed and evaluated as follows:

○; no toner was scattered,

Δ; some amount of toner scattered and the inside of the printer was soiled, but the image was not affected, and X; scattering of toner occurred, the scattered toner was exhausted outside the machine by the exhaust fan, and further a part of the scattered toner adhered to the transfer route of sheet paper, and the image was smeared.

Evaluation of resistance to spent phenomenon of toner to carrier was done on the developer after 150 thousands sheets were printed. Specifically, the developer was put on a sieve of 635 meshes, toner was removed by sucking from under the sieve. The carrier remained on the sieve was dipped into THF solution, the supernatant liquid was measured by GPC, and the amount of toner adhered to the carrier was determined based on the detected peak area. When the amount of toner spent to carrier was reaches 0.50 mg/g per 1.0 g of carrier, influence to image density and background fogging was observed, so toner spent was evaluated to be good (OK) when the amount of toner spent was smaller than 0.50 mg/g.

Occurrence of scratch streaks on the surface of the photoreceptor drum by the contact thereto of the magnetic brush was visually observed and evaluated as follows:

○; no scratch streak was developed,; fine streaks was observed on the photoreceptor drum, but the image was not affected, and Δ; some streaks were observed on the photoreceptor drum, but the image was not affected.

X; streaks were clearly observed on the photoreceptor drum, and further irregularity was recognized in the image.

TABLE 1

| | PARTICLE SHAPE OF MAGNETIC PARTICLE | SATURATION MAGMETIZATION ($Am^2/kg$) |
|---|---|---|
| E. Exp. 1 | R.OCTAHEDRON | 8.0 |
| E. Exp. 2 | R.OCTAHEDRON | 5.2 |
| E. Exp. 3 | R.OCTAHEDRON | 13.6 |
| C. Exp. 1 | C.OCTAHEDRON | 8.4 |
| C. Exp. 2 | F.OCTAHEDRON | 8.1 |
| C. Exp. 3 | C.CUBE | 8.2 |
| C. Exp. 4 | F.CUBE | 7.7 |
| C. Exp. 5 | SPHERE | 7.9 |
| C. Exp. 6 | R.OCTAHEDRON | 3.2 |
| C. Exp. 7 | R.OCTAHEDRON | 16.8 |

Note:
E. Exp.; Embodiment example,
C. Exp.; Comparative example.

TABLE 2

| | IMAGE DENSITY | | BACKGROUND FOGGING | | TONER SPENT | | MAGNETIC BRUSHSTREAK | TONER SCAT. |
|---|---|---|---|---|---|---|---|---|
| | IN. | IN. | IN. | A.D. | AMOUNT | EV. | A.D. | A.D. |
| E. Exp. 1 | 1.43 | 1.40 | ○ | ○ | 0.41 | ○ | ○ | ○ |
| E. Exp. 2 | 1.43 | 1.41 | ○ | ○ | 0.38 | ○ | ○ | ○ |
| E. Exp. 3 | 1.41 | 1.37 | ○ | ○ | 0.44 | ○ | ○ | ○ |
| C. Exp. 1 | 1.41 | 1.39 | ○ | Δ | 0.30 | ○ | X | Δ |
| C. Exp. 2 | 1.37 | 1.36 | ○ | ○ | 0.32 | ○ | X | Δ |
| C. Exp. 3 | 1.40 | 1.35 | ○ | Δ | 0.29 | ○ | X | Δ |
| C. Exp. 4 | 1.39 | 1.38 | ○ | ○ | 0.35 | ○ | X | Δ |
| C. Exp. 5 | 1.43 | 1.17 | ○ | X | 0.89 | X | ○ | ○ |
| C. Exp. 6 | 1.43 | 1.33 | ○ | Δ | 0.40 | ○ | ○ | X |
| C. Exp. 7 | 1.37 | 1.20 | ○ | X | 0.68 | X | X | ○ |

Note:
E. Exp.; Embidiment example,
C. Exp.; Comparative example,
IN.; Initial,
A.D.; After endurance printing,
EV.; Evaluation result;
SCAT.; Scattering, and
Unit of spent amount; mg/g As can be recognized from Table 2, in embodiment examples 1 to 3 of rounded octahedron in which magnetic particle of octahedral shape with vertexes and edges being curved faces was used, the saturation magnetization was in a range of 5.0 to 13.8 $Am^2/kg$, the image characteristic was good due to the effect of the magnetic particle and there was no problem of spent phenomenon, magnetic brush streaks, toner scattering. This was maintained until after endurance printing of 150 thousands sheets, and it can be recognized that the toner life was extended.

On the contrary, in the cases of comparative example 1 in which the shape of magnetic particle was octahedral with vertexes and edges being not curved surfaces (see FIG. 1C, cornered octahedron), comparative example 2 in which the shape of magnetic particle was octahedral with vertexes and edges being chamfered to be small flat surfaces (see FIG. 6 of patent literature 3, chamfered octahedron), comparative example 3 in which the shape of magnetic particle was cube with vertexes and edges being not curved surfaces (see FIG. 1B, cornered cube), and comparative example 4 in which the shape of magnetic particle was cube with vertexes and edges being chamfered to be small flat surfaces (see FIG. 1B, chamfered cube), magnetic brush streaks developed because of the existence of pointed vertexes and sharp edges of the magnetic particle in spite of the fact that the saturation magnetization was 8.4, 8.1, 8.2, and 7.7 $Am^2/kg$ respectively.

Further, in the case of comparative example 5 of spherical magnetic particle (see FIG. 1A), the spent phenomenon occurred and background fogging due to the spent was observed after the endurance printing although the saturation magnetization was 7.9 $Am^2/kg$. Further, in the case of comparative example 6 in which the shape was rounded octahedron the same as the cases of embodiment examples 1 to 3 but the saturation magnetization was low as 7.7 $Am^2/kg$, effect to be expected by containing magnetic particle that scattering or falling-off of toner is prevented by magnetic attraction between the toner and carrier and occurrence of background fogging is suppressed, was not obtained and toner scattering and background fogging was observed.

In the case of comparative example 7 in which the shape was rounded octahedron the same as the cases of embodiment examples 1 to 3 but the saturation magnetization was high as 16.8 $Am^2/kg$, magnetic constraining force between the toner and carrier is too strong due to excessively high saturation magnetization, magnetic brush streaks developed on the photoreceptor drum, and also the spent of toner to carrier occurred due to the same reason.

From these results, it can be recognized that the magnetic particle is preferable to be of octahedral shape with vertexes and edges being curved surfaces (rounded octahedron) and its saturation magnetization measured in a magnetic field of 79.6 kA/m is in a range of 4.0 to 15.0 $Am^2/kg$, which range is between the minimum of 3.2 $Am^2/kg$ and maximum of 16.8 $Am^2/kg$.

Saturation magnetization of toner was measured by a vibration type magnetometer (Model VSM-P7-15, TOEI Ind. Co. made) by receiving 50 mg of toner which had been stored under usual temperature and humidity (20° C., 65% RH) in a cylindrical cell and depicting a hysteresis curve in one minute under a magnetic field of 79.6 kA/m (1 kOe).

As has been described heretofore, according to the present invention, by using magnetic particle contained in the toner for two-component developer which is of basically octahedral shape and having its vertexes and edges formed into curved surfaces, toner can be obtained which has a charging characteristic of quick increasing in charge amount and at the same time of a tendency not to be overcharged. As a result, magnetic toner for two-component developer can be obtained with which toner scattering, toner spent to carrier, development of magnetic brush streaks which has been peculiar problems for two-component developers can be prevented and a good image characteristic (in image density and background fogging) can be maintained for an extended period. Therefore, magnetic toner for two-component developers of long durability while allowing to maintain the good image characteristic and an image forming method using the developer can be provided.

What is claimed is:

1. A magnetic toner for a two-component developer comprising toner containing magnetic particle in a binder resin thereof and carriers, wherein the magnetic particle is of basically polyhedral shape, vertexes and edges of said polyhedral particle are curved surfaces, said particle has peripheral parts taken as straight lines in a projected image of the polyhedral particle, and saturation magnetization of said toner in a magnetic field of 79.6 kA/m is 4.0 to 15.0 $Am^2/kg$.

2. A magnetic toner for a two-component developer according to claim 1, wherein said polyhedron is a convex octahedron surrounded with eight triangles.

3. A magnetic toner for a two-component developer according to claim 2, wherein the average size of said magnetic particle is 0.01 to 0.50 μm.

4. An image forming method in which a two-component developer comprising carriers and toner which contains magnetic particle at least in a binder resin thereof, the magnetic particle being of basically polyhedral shape, vertexes and edges of said polyhedral shape being curved surfaces, said shape having peripheral parts taken as straight lines in a projected image of the polyhedral particle, saturation magnetization of said toner in a magnetic field of 79.6 kA/m being 4.0 to 15.0 $Am^2/kg$, is used, and the toner retaining members (carriers) bearing at least said magnetic toner to which electric charge is injected are allowed to face a latent image retaining member and an electrostatic latent image on said latent image retaining member is developed with said magnetic toner.

5. An image forming method according to claim 4, wherein said two-component developer comprising said carriers and said magnetic toner is allowed to form a chain of particles of the developer extending from said toner retaining member (hereafter referred to as a magnetic brush) toward the developing region of said latent image retaining member facing said toner retaining member by utilizing a magnetic field, whereby said latent image on said latent image retaining member is visualized as a toner image by allowing said magnetic brush to contact with the surface of said latent image retaining member, and wherein said magnetic toner contains magnetic particle at least in said binder resin, said magnetic particle has an average size of 0.01 to 0.50 μm and shape of basically polyhedron, further vertexes and edges of the polyhedral particle are rounded to be curved surfaces, and said particle has peripheral parts taken as straight lines in a projected image of the polyhedral particle.

6. An image forming method according to claim 4, wherein said polyhedron is a convex octahedron surrounded with eight triangles.

* * * * *